US006595516B2

(12) United States Patent
Kallin et al.

(10) Patent No.: US 6,595,516 B2
(45) Date of Patent: Jul. 22, 2003

(54) RETRACTABLE TRACK IDLER APPARATUS FOR USE IN A DOCUMENT PROCESSING SYSTEM

(75) Inventors: Fredrik L. N. Kallin, Waterloo (CA); Anthony J. Boon, Kitchener (CA)

(73) Assignee: NCR Corporation, Dayton, OH (US)

( * ) Notice: Subject to any disclaimer, the term of this patent is extended or adjusted under 35 U.S.C. 154(b) by 57 days.

(21) Appl. No.: 09/992,185

(22) Filed: Nov. 16, 2001

(65) Prior Publication Data

US 2003/0094750 A1 May 22, 2003

(51) Int. Cl.[7] ..... B65H 5/02
(52) U.S. Cl. ..... 271/273
(58) Field of Search ..... 271/272, 273; B65H 5/02

(56) References Cited

U.S. PATENT DOCUMENTS 4,570,923 A * 2/1986 Hooper et al. ..... 271/275
4,815,726 A * 3/1989 Pagowski et al. ..... 271/274
5,011,129 A * 4/1991 Holbrook ..... 271/274
5,158,280 A * 10/1992 Sanchez ..... 271/274
5,377,805 A * 1/1995 Ono et al. ..... 194/206
6,102,390 A * 8/2000 DeFigueiredo et al. ..... 271/124

* cited by examiner

*Primary Examiner*—Donald P. Walsh
*Assistant Examiner*—Kenneth W Bower
(74) *Attorney, Agent, or Firm*—Michael Chan

(57) ABSTRACT

A check processing module includes a hardware device disposed along a document track. The hardware device processes document items moving from an upstream end of the document track to a downstream end of the document track. A number of outer panels covers the hardware device during operation of the check processing module. At least one idler roller engages a document item in the document track when the idler roller is in a non-retracted position. An actuatable mechanism is provided for, when actuated, moving the idler roller from the non-retracted position to a retracted position away from a document item in the document track to allow an operator to more easily gain access to the document track while the outer panels remain covering the hardware device positioned along the document track.

4 Claims, 17 Drawing Sheets

RETRACTABLE TRACK IDLER APPARATUS FOR USE IN A DOCUMENT PROCESSING SYSTEM

The related application entitled "Retractable Track Guide Apparatus For Use In A Document Processing System" is filed on even date herewith.

BACKGROUND OF THE INVENTION

The present invention relates to document processing systems, and is particularly directed to a retractable track idler apparatus for use in a document processing system, such as an image-based check processing system.

A typical image-based check processing system includes a check processing transport which has a document track and a number of check processing modules positioned along the document track for performing specific document processing operations on document items including checks moving downstream along the document track. Each check processing module includes a number of outer panels which cover a number of hardware devices contained within the check processing module during operation of the check processing transport. The check processing system also includes a transport processor which executes a transport application program which is stored in memory to control operation of the hardware devices contained within the check processing modules positioned along the document track and thereby to control operation of the check processing transport.

More specifically, the check processing transport includes a hopper module into which a stack of document items are placed. A document feeder module adjacent the hopper module selectively feeds or drives each document item from the stack of document items in the hopper module to transport the document item from the upstream end to the downstream end along the document track to sorting pockets of a pocket module located at the end of the document track. The pockets receive document items which have been sorted in accordance with the transport application program.

From time to time, a document item jam may occur while processing document items on the check processing transport. Typically, when a document item jam occurs, an operator manually locates any document items in the document track that have not been completely processed and removes these document items from the document track. To avoid problems further downstream, the operator must ensure that all document items which have not been completely processed are removed from the document track. Once the problem that caused the document item jam is resolved, the operator must reprocess the document items in their original order.

When a jammed document item is removed from the document track, it is desirable to be able to easily remove the document item and to not tear the document item while the document item is being removed from the document track. In known check processing modules, at least one outer panel covering the hardware devices contained within that check processing module needs to be opened and/or removed before a jammed document item can be removed from the document track. After the at least one outer panel is opened and/or removed, a number of idler rollers associated with the check processing module usually needs to be moved away from the jammed document item to release the document item before the document item can be removed from the document track.

SUMMARY OF THE INVENTION

In accordance with one aspect of the present invention, a retractable track idler apparatus is provided for use in a document processing system having a document track, a number of hardware devices positioned along the document track, and a number of outer panels covering the hardware devices. The retractable track idler apparatus comprises at least one idler roller for engaging a document item in the document track when the idler roller is in a non-retracted position. Manually-operable means is provided for, when operated by an operator at a first time, moving the idler roller from the non-retracted position to a retracted position away from a document item in the document track to allow the operator to more easily gain access to the document track while the outer panels remain covering the hardware devices positioned along the document track. The manually-operable means may include an actuatable member accessible to the operator from above the document track. The retractable track idler apparatus may further comprise means for moving the idler roller from the retracted position back to the non-retracted position while the outer panels remain covering the hardware devices positioned along the document track when the manually-operable means is operated by the operator at a second time which is after the first time.

In accordance with another aspect of the present invention, a retractable track idler apparatus comprises at least one idler roller for engaging a document item in a document track when the idler roller is in a non-retracted position. Manually-operable means is provided for, when operated a first time after a document item jam condition occurs along the document track, moving the idler roller from the non-retracted position to a retracted position away from a document item jammed in the document track to allow the jammed document item to be easily removed from the document track. Latching means is provided for latching the idler roller in the retracted position when the manually-operable means is operated the first time. Means is provided for unlatching the idler roller to allow the idler roller to move from the retracted position back to the non-retracted position when the manually-operable means is operated a second time which is after the first time. The manually-operable means may include an actuatable member accessible to the operator from above the document track.

In accordance with yet another aspect of the present invention, a retractable track idler apparatus comprises at least one idler roller for engaging a document item in a document track when the idler roller is in a non-retracted position. A first actuatable mechanism is provided for, when actuated a first time after a document item jam condition occurs along the document track, moving the idler roller from the non-retracted position to a retracted position away from a document item jammed in the document track to allow the jammed document item to be easily removed from the document track. A second actuatable mechanism is provided for, when actuated, latching the idler roller in the retracted position when the first actuatable mechanism is actuated the first time. A third actuatable mechanism provided for, when actuated, unlatching the idler roller to allow the idler roller to move from the retracted position back to the non-retracted position when the first actuatable mechanism is actuated a second time which is after the first time. The first actuatable mechanism may include an actuatable member accessible to the operator from above the document track.

In accordance with still another aspect of the present invention, a check processing module comprises means defining at least a portion of a document track along which document items can move from an upstream end to a downstream end. A hardware device disposed along the document track is provided for processing document items moving from the upstream end of the document track to the downstream end of the document track. A number of outer panels covers the hardware device during operation of the check processing module. At least one idler roller is provided for engaging a document item in the document track when the idler roller is in a non-retracted position. An actuatable mechanism is provided for, when actuated, moving the idler roller from the non-retracted position to a retracted position away from a document item in the document track to allow an operator to more easily gain access to the document track while the outer panels remain covering the hardware device positioned along the document track. The actuatable mechanism may include an actuatable member accessible to the operator from above the document track.

In accordance with still another aspect of the present invention, a check processing system comprises a number of idler rollers for engaging a document item in a document item track when the idler rollers are in a non-retracted position. Means is provided for biasing the idler rollers to the non-retracted position. Actuatable means is provided for (i) when actuated a first time in response to an operator operating the actuatable means against the biasing means, moving the idler rollers from the non-retracted position to a retracted position away from a document item in the document track, and (ii) when actuated a second time which is after the first time in response to an operator operating the actuatable means, allowing the idler rollers to move from the retracted position back to the non-retracted position. The actuatable means may include an actuatable member accessible to the operator from above the document track.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
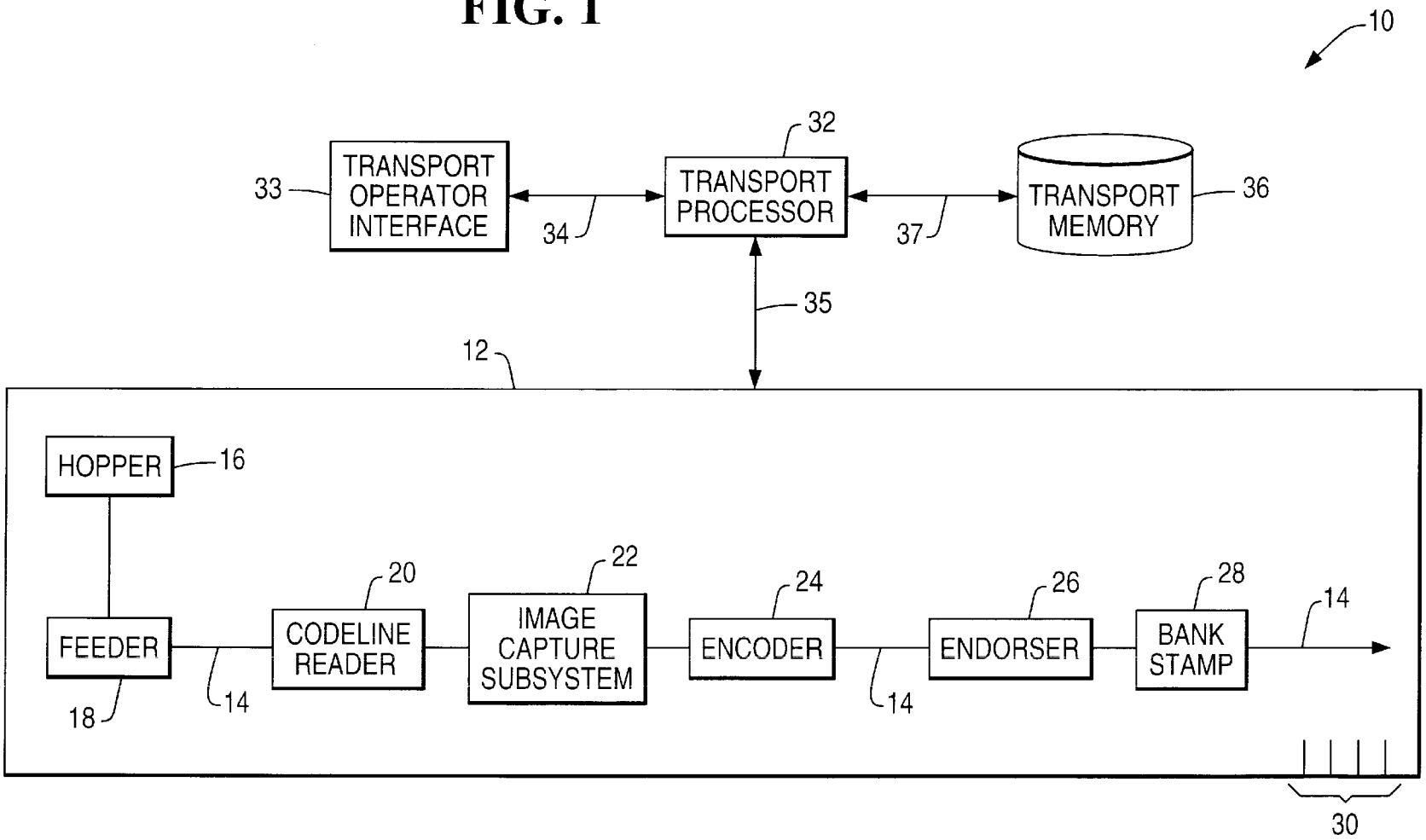
FIG. 1 is a schematic block representation of an image-based check processing system embodying the present invention.

The present invention is directed to a retractable track idler apparatus for use in a document processing system. The specific construction and use of the document processing system may vary. By way of example, a document processing system in the form of an image-based check processing system 10 is illustrated in FIG. 1. The check processing system 10 may be, for example, a sorting machine or a proof machine wherein financial document items such as checks are processed in a bank.

As shown in FIG. 1, the check processing system 10 includes a check processing transport 12 having a document track 14 along which financial document items, such as checks, can be transported from an upstream end to a downstream end. The transport 12 includes a number of different check processing modules lying along the document track 14. Each check processing module includes a number of hardware devices associated with the particular check processing module for performing specific document processing operations on document items moving along the document track. The transport 12 includes a hopper module 16 into which a stack of financial document items including checks are placed. A document feeder module 18 adjacent the hopper 16 selectively feeds or drives each document item from the stack of document items in the hopper to transport the document item from the upstream end to the downstream end along the document track 14 to sorting pockets of a pocket module 30 located at the end of the document track.

The check processing system 10 includes a codeline reader module 20 such as a MICR reader located along the document track 14. The MICR reader 20 reads a MICR codeline from each check being processed in a known manner. Alternatively, the codeline reader may be an OCR reader instead of a MICR reader depending upon the particular application. The check processing system 10 further includes an image capture subsystem module 22 located along the document track 14. The image capture subsystem 22 captures an image of each document item for a number of different purposes well known in the financial industry. More specifically, the image capture subsystem 22 includes an imaging camera (not shown) which is controlled to capture images of document items moving along the document track 14. An encoder module 24 encodes missing fields on each check. An endorser module 26 applies an endorsement in a known manner to each check. A bank stamp module 28 stamps each check to identify the bank institution processing the check. The structure and operation of MICR readers, OCR readers, imaging cameras, encoders, endorsers, and bank stamps are well known and, therefore, will not be described.

The check processing system 10 further includes a transport processor 32 and a transport operator interface 33 which communicates via signals on line 34 with the transport processor. The operator interface 33 may include a keyboard, a mouse, and a display, all of which communicate via signals with the transport processor 32. The transport processor 32 controls operation of the transport 12 via signals on line 35. Suitable processors and memories are readily available in the marketplace. Their structure and operation are well known and, therefore, will not be described.

The check processing system 10 also includes a transport memory 36 which communicates via signals on line 37 with the transport processor 32. It is contemplated that the memory 36 could be a single memory unit or a plurality of different memory units. An executable transport application program is stored in the memory 36. The transport application program is associated with a particular type of document processing work. For example, one type of work is proof of deposit. Another type of work is remittance processing. Still another type of work may be sorting of document items. When the transport application program is executed, the hardware devices contained within the check processing modules lying along the document track 14 are controlled to process document items moving downstream along the document track in accordance with the transport application program, as is known. The memory 36 also stores sequence numbers, MICR codelines, image data, encoder status, endorsement status, and bank stamp status associated with document items which have been processed in accordance with the transport application program.

Figure 2:
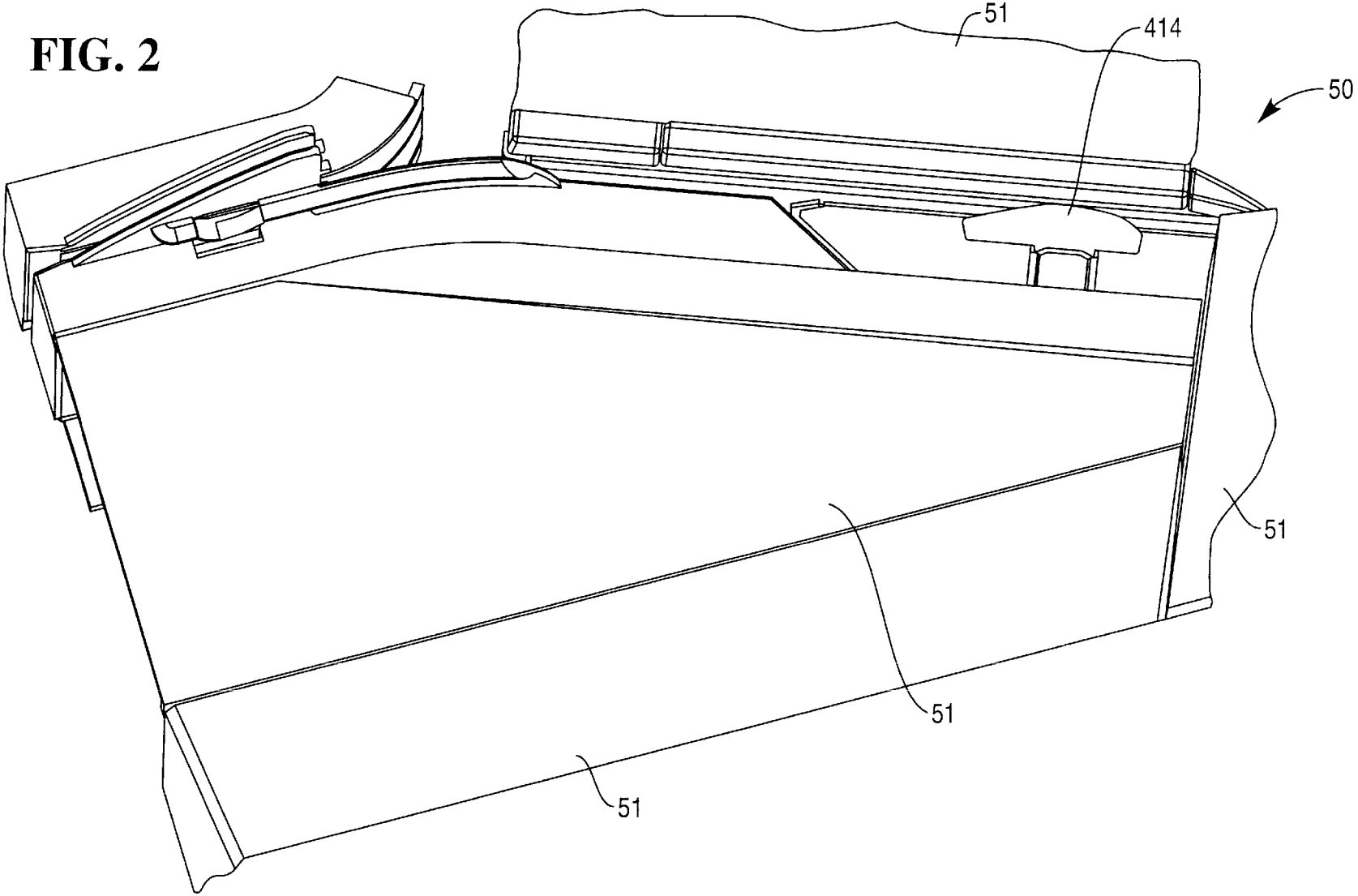
FIG. 2 is a top perspective view of a retractable track idler apparatus used in the image-based check processing system of FIG. 1 and shown in a non-retracted position.
Figure 3:
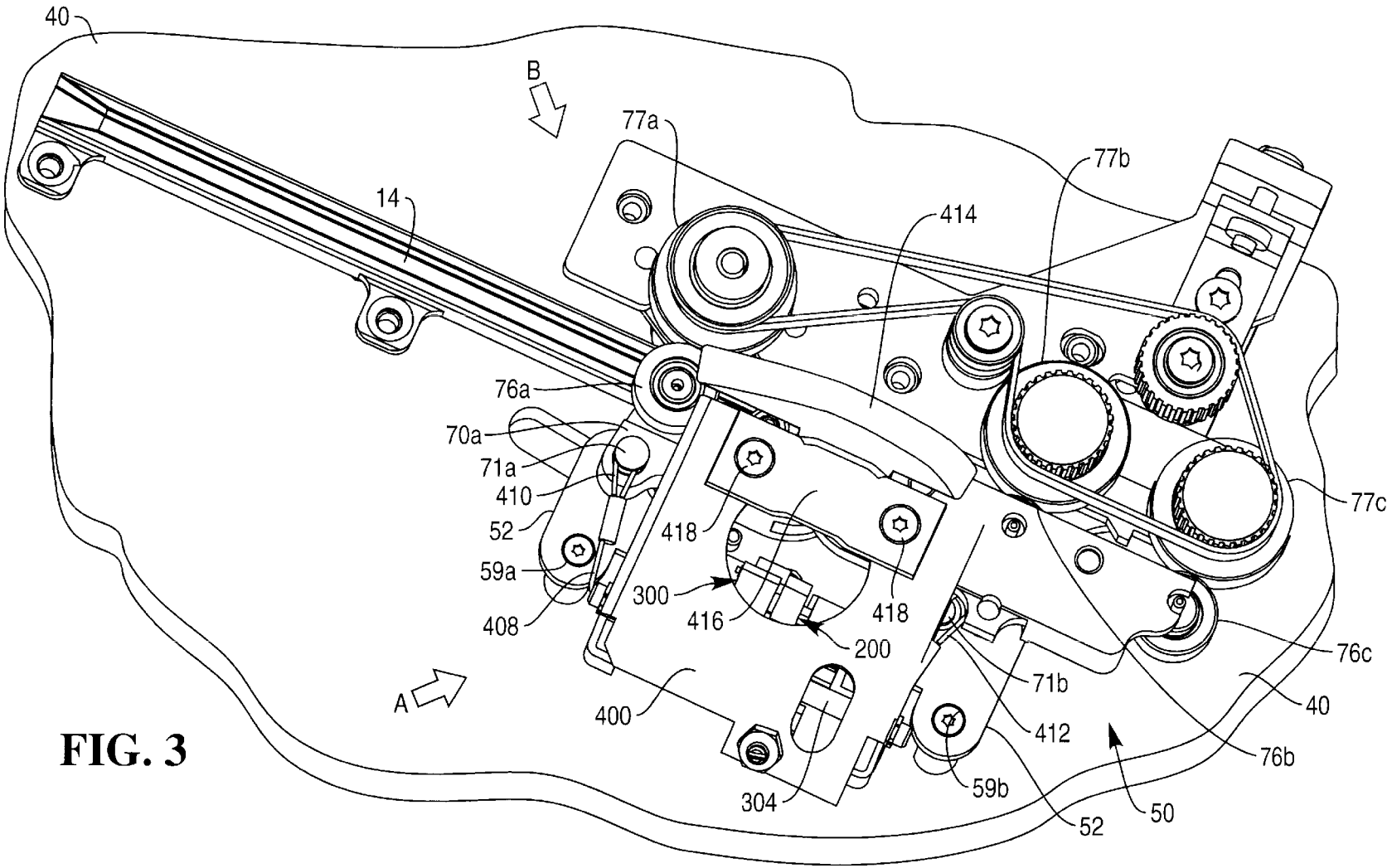
FIG. 3 is an enlarged perspective view of a portion of FIG. 2 and showing some parts including a number of outer panels removed.
Figure 4:
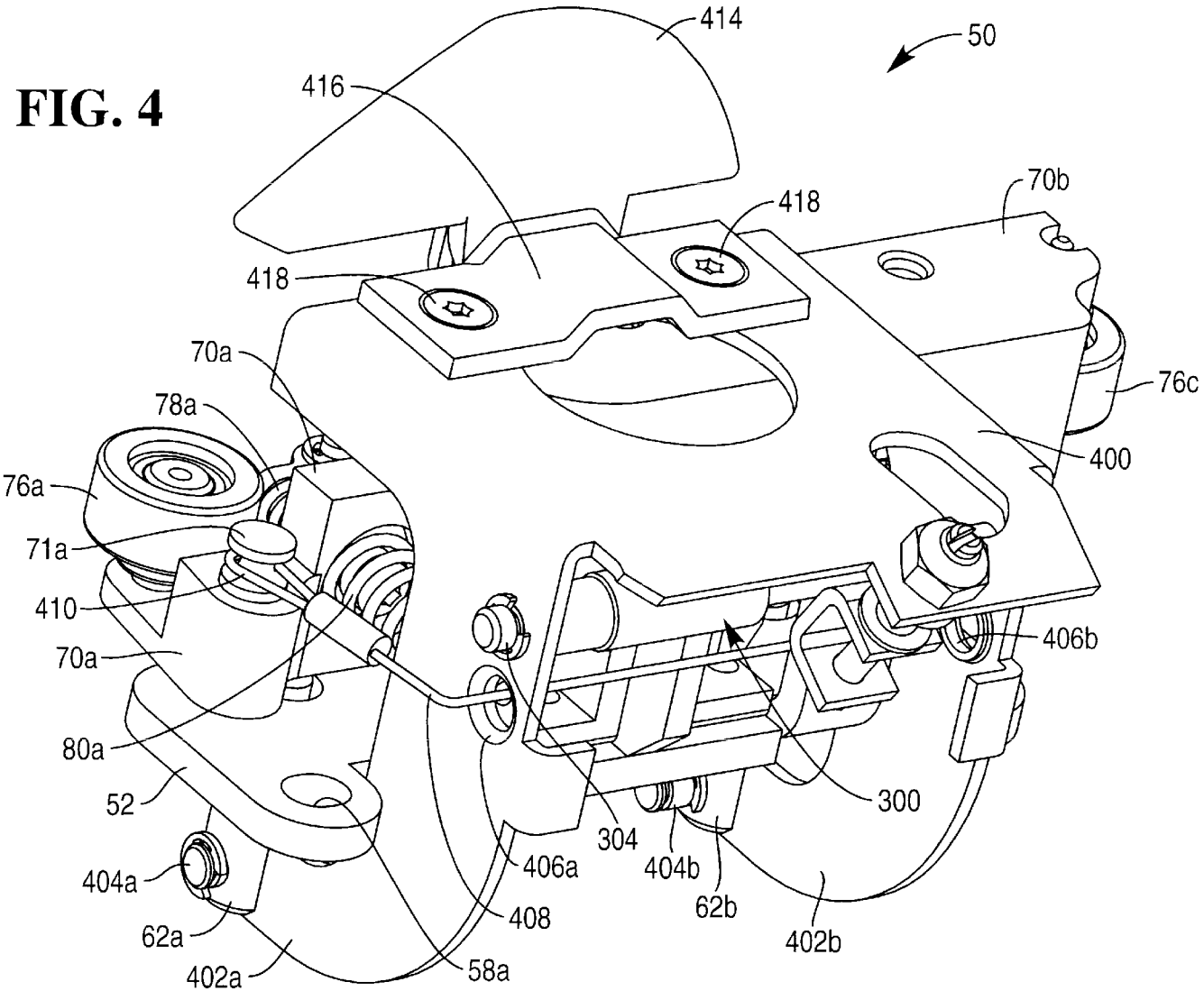
FIG. 4 is a perspective view looking approximately in the direction of arrow A in FIG. 3 and showing more parts removed.
Figure 5:
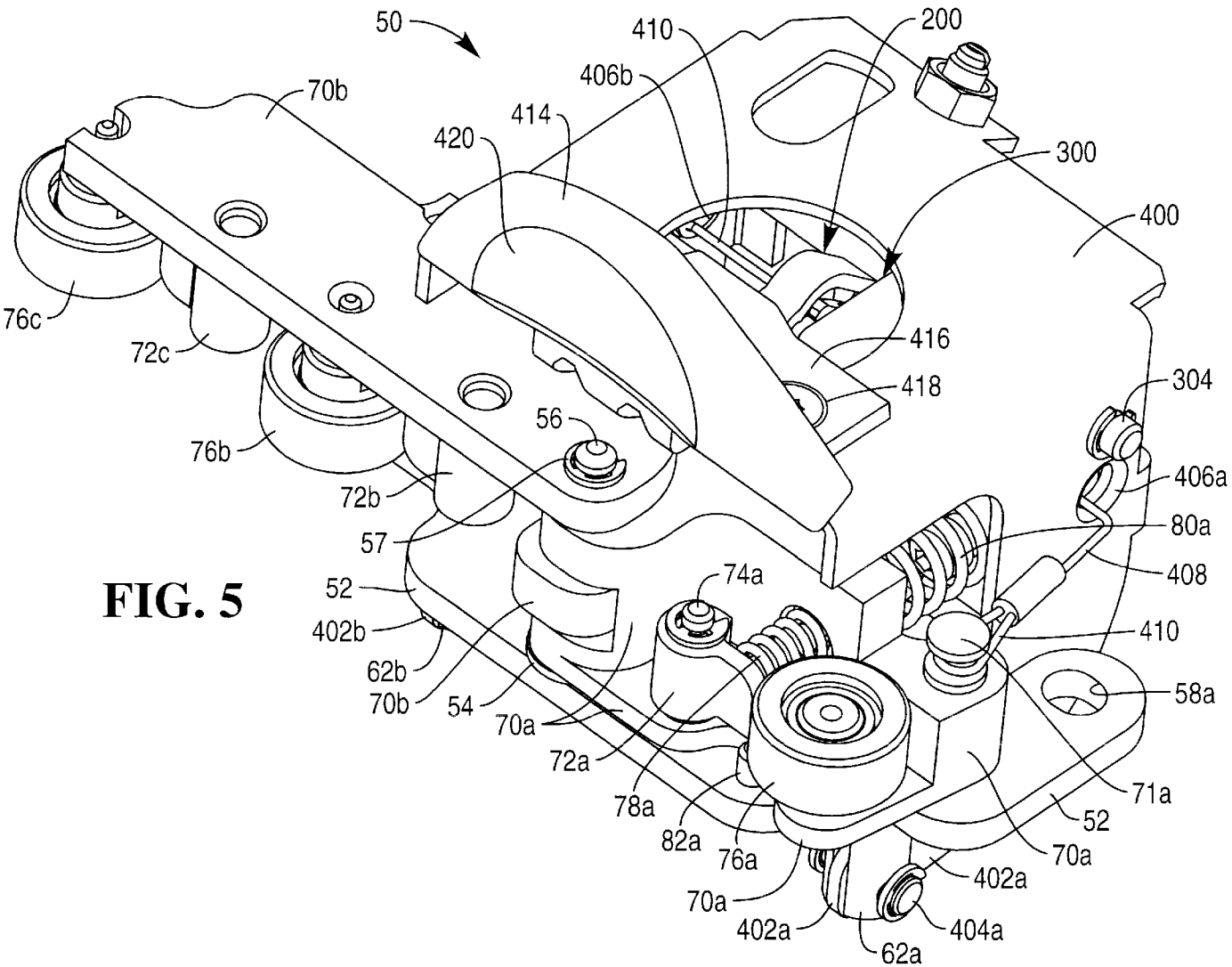
FIG. 5 is a perspective view looking approximately in the direction of arrow B in FIG. 3 and showing more parts removed.
Figure 6:
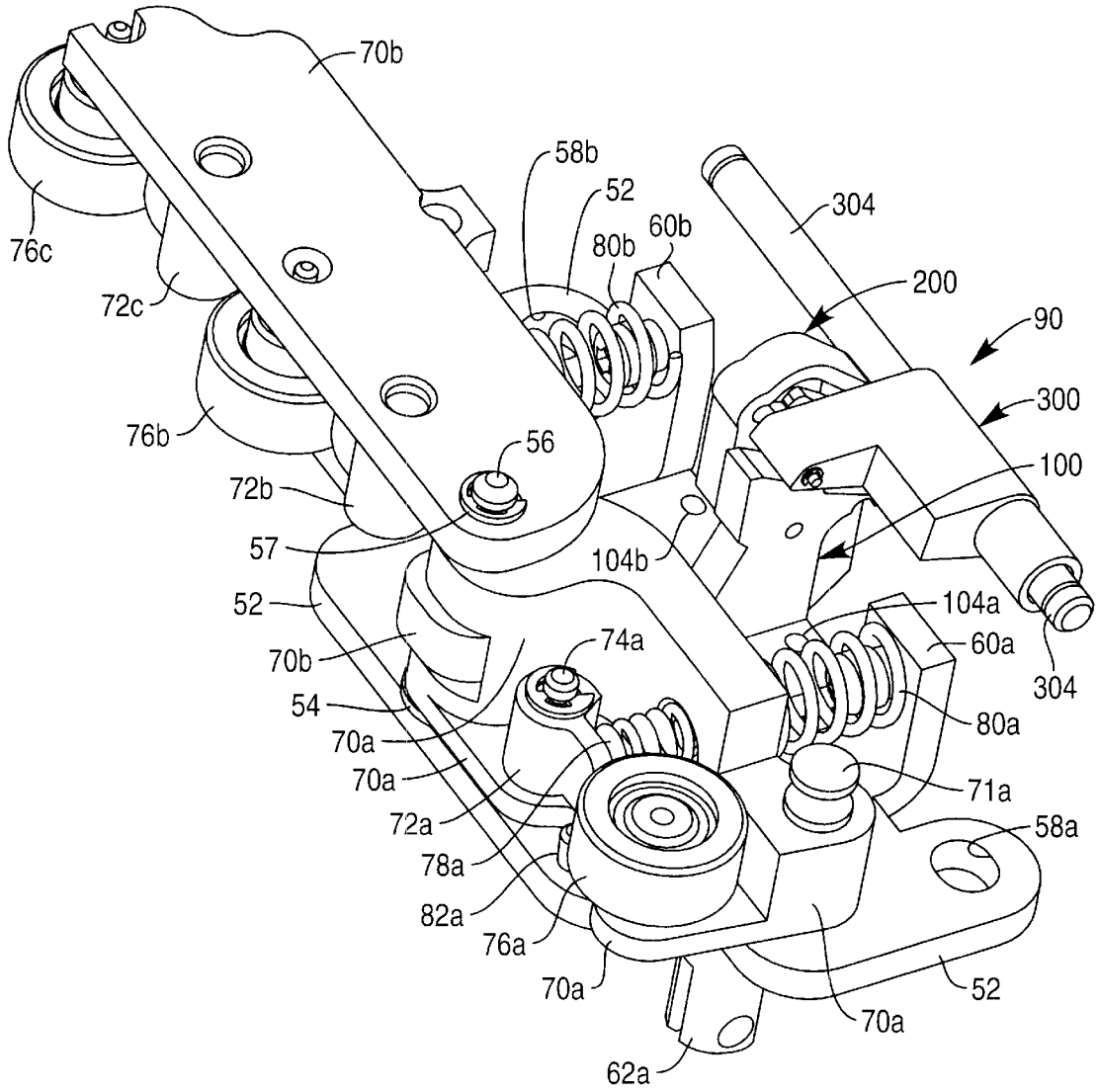
FIG. 6 is a perspective view similar to FIG. 5 and showing more parts removed.

Referring to FIG. 2, a retractable track idler apparatus 50 in accordance with the present invention is illustrated. The apparatus 50 is embodied in a typical check processing module and is shown in FIG. 2 in a non-retracted position. A number of outer panels 51 associated with the particular check processing module covers the apparatus 50. FIG. 3 is an enlarged perspective view of a portion FIG. 2 and shows some parts including the outer panels 51 removed. FIGS. 4 and 5 are perspective views looking approximately in the directions of arrows "A" and "B", respectively, in FIG. 3. FIG. 6 is a view similar to FIG. 5 and showing more parts removed for the purpose explaining the structure and cooperation of different parts. Parts of the apparatus 50 are in the non-retracted position shown in FIGS. 2–6 during normal operation of the particular check processing module in which the apparatus is installed.

A typical check processing module usually has a baseplate to which components making up the hardware device(s) associated with the check processing module are attached. For purposes of describing the present invention, a baseplate of the particular check processing module in which the apparatus 50 is installed is designated in FIG. 3 with the reference numeral "40".

Referring to FIGS. 3, 4, 5, and 6, the retractable track idler apparatus 50 includes a main plate 52 on which a disc-shaped shoulder portion 54 (FIGS. 5 and 6) is disposed. The main plate 52 also has a shaft portion 56 which is disposed on the center of the disc-shaped shoulder portion 54. The main plate 52 has a pair of mounting holes 58*a*, 58*b* through which suitable fasteners 59*a*, 59*b* (FIG. 3) can be used to secure the main plate 52 to the baseplate 40. The main plate 52 also has first and second upward-projecting flange portions 60*a*, 60*b* (as best shown in FIG. 6), and first and second downward-projecting extensions 62*a*, 62*b* (as best shown in FIGS. 4 and 5).

A first idler mount 70*a* having a shape as best shown in FIG. 6 is pivotably mounted about the shaft portion 56 of the main plate 52. The shoulder portion 54 of the main plate 52 supports the first idler mount 70*a* for pivoting movement about the shaft portion 56. One end of a first idler arm 72*a* (as best shown in FIGS. 5 and 6) is pivotably mounted about a first pivot shaft 74*a*. A first idler roller 76*a* is rotatably mounted at the other end of the first idler arm 72*a*. The first idler roller 76*a* faces a first drive roller 77*a* (shown in FIG. 3 only) which lies on the other side of the document track 14.

A first pressure spring 78*a* is resiliently connected between the first idler arm 72*a* and the first idler mount 70*a*, and a first return spring 80*a* is resiliently connected between the first idler mount 70*a* and the first upward-projecting flange portion 60*a*, as best shown in FIG. 6. A first stop pin 82*a* (FIGS. 5 and 6) is fixedly mounted to the main plate 52 to limit movement of the first idler mount 70*a*. The first idler mount 70*a* also has a first stud portion 71*a* to which a cable can be connected, as will be described later.

A second idler mount 70*b* having a shape as best shown in FIG. 6 is also pivotably mounted about the shaft portion 56 of the main plate 52. As shown in FIGS. 5 and 6, the second idler mount 70*b* and the first idler mount 70*a* are interleaved about the shaft portion 56 of the main plate 52. A C-clip 57 secures the first and second idler mounts 70*a*, 70*b* for pivoting movement about the shaft portion 56. One end of a second idler arm 72*b* is pivotably mounted about a second pivot shaft (not shown) in the same manner as the first idler arm 72*a* is pivotable about the first pivot shaft 74*a*. A second idler roller 76*b* is rotatably mounted at the other end of the second idler arm 72*b*. The second idler roller 76*b* faces a second drive roller 77*b* (shown in FIG. 3 only) which lies on the other side of the document track 14.

A second pressure spring (not shown) is resiliently connected between the second idler arm 72*b* and the second idler mount 70*b* in the same manner that the first pressure spring 78*a* is resiliently connected between the first idler arm 72*a* and the first idler mount 70*a*. A second return spring 80*b* (FIG. 6) is resiliently connected between the second idler mount 70*b* and the second upward-projecting flange portion 60*b* in the same manner that the first return spring 80*a* is resiliently connected between the first idler mount 70*a* and the first upward-projecting flange portion 60*a*. A second stop pin (not shown) is fixedly mounted to the main plate 52 to limit movement of the second idler mount 70*b* in the same manner that the first stop pin 82*a* (FIGS. 5 and 6) limits movement of the first idler mount 70*a*. The second idler mount 70*b* has a second stud portion 71*b* to which a cable can be connected, as will be described later.

One end of a third idler arm 72*c* (FIGS. 5 and 6) is pivotably mounted about a third pivot shaft (not shown) in the same manner as the first idler arm 72*a* is pivotable about the first pivot shaft 74*a*. A third idler roller 76*c* is rotatably mounted at the other end of the third idler arm 72*c*. The third idler roller 76*c* faces a third drive roller 77*c* (shown in FIG. 3 only) which lies on the other side of the document track 14. A third pressure spring (not shown) is resiliently connected between the third idler arm 72*c* and the second idler mount 70*b* in the same manner that the first pressure spring 78*a* is resiliently connected between the first idler arm 72*a* and the first idler mount 70*a*.

Figure 7:
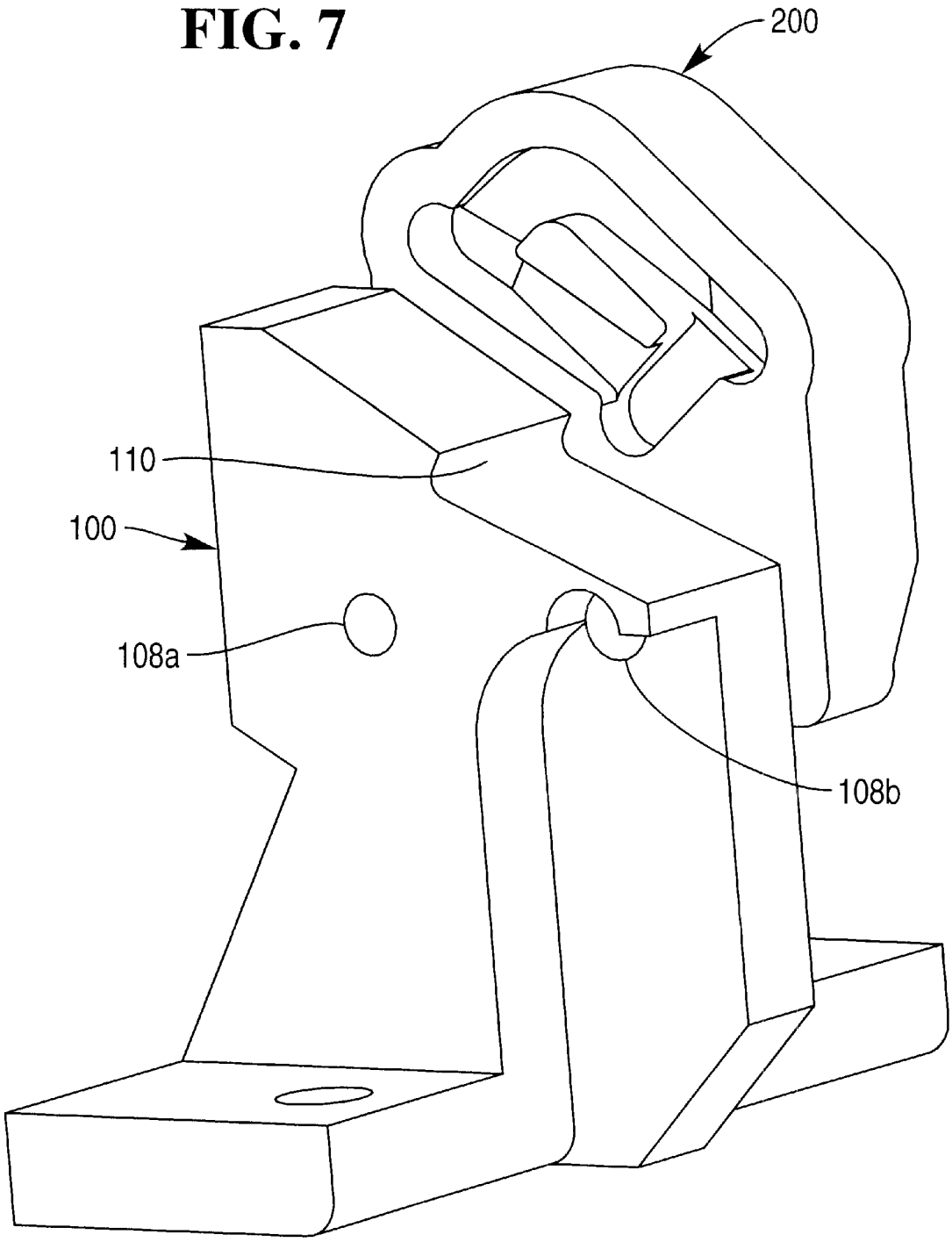
FIG. 7 is a perspective view of certain parts used in FIG. 6.

A latching mechanism 90 (as best shown in FIG. 6) is disposed on the main plate 52 between the first and second upward-projecting flange portions 60*a*, 60*b*. More specifically, the latching mechanism 90 includes a cam holder piece 100 having a shape as best shown in FIG. 7. The cam holder piece 100 is securely mounted to the main plate 52 using a pair of suitable fasteners 104*a*, 104*b* (FIG. 6). As shown in FIG. 7, the cam holder piece 100 has a step surface 110 for purposes to be described later.

Figure 8:
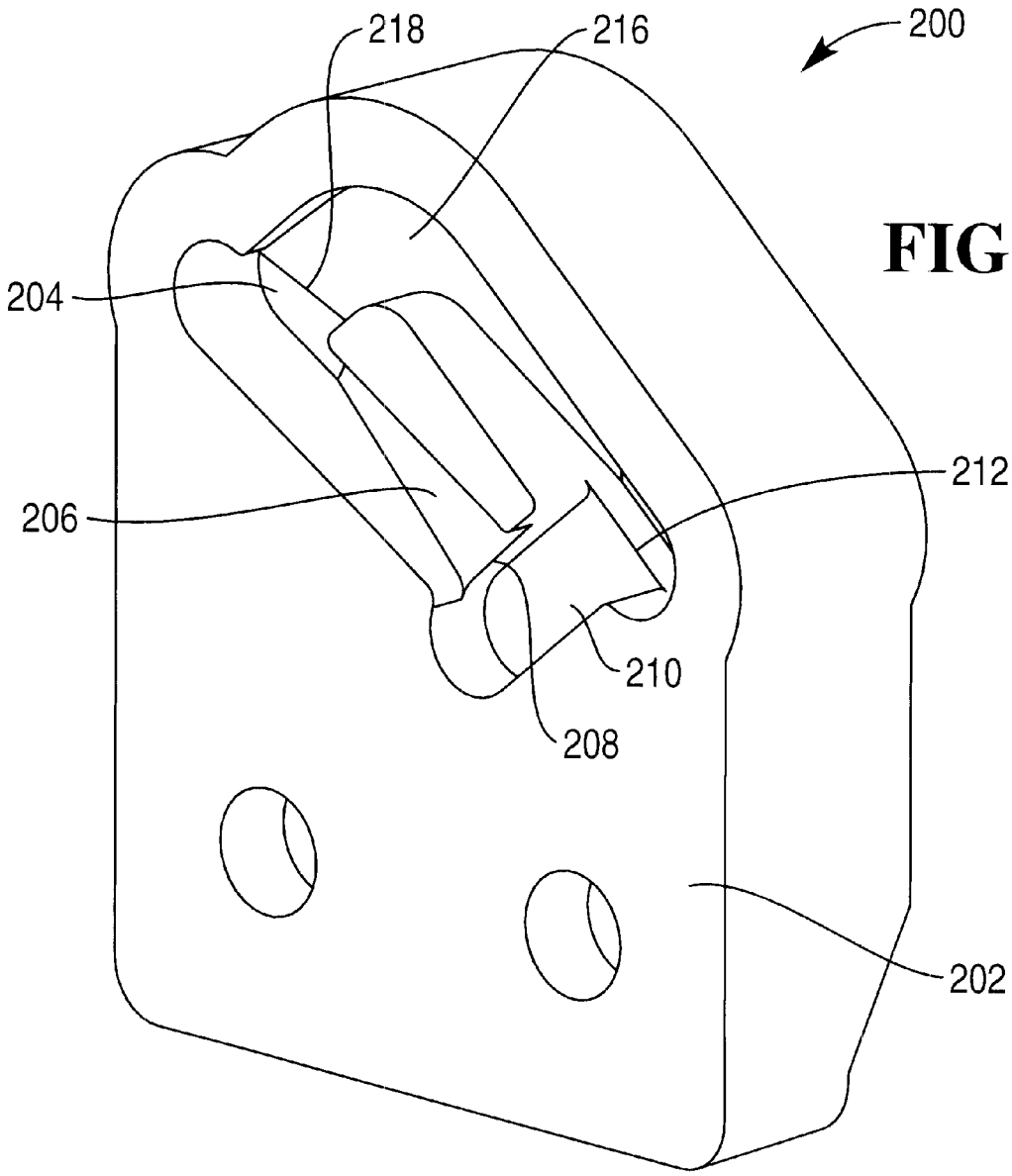
FIG. 8 is a perspective view of one of the parts shown in FIG. 7.
Figure 9:
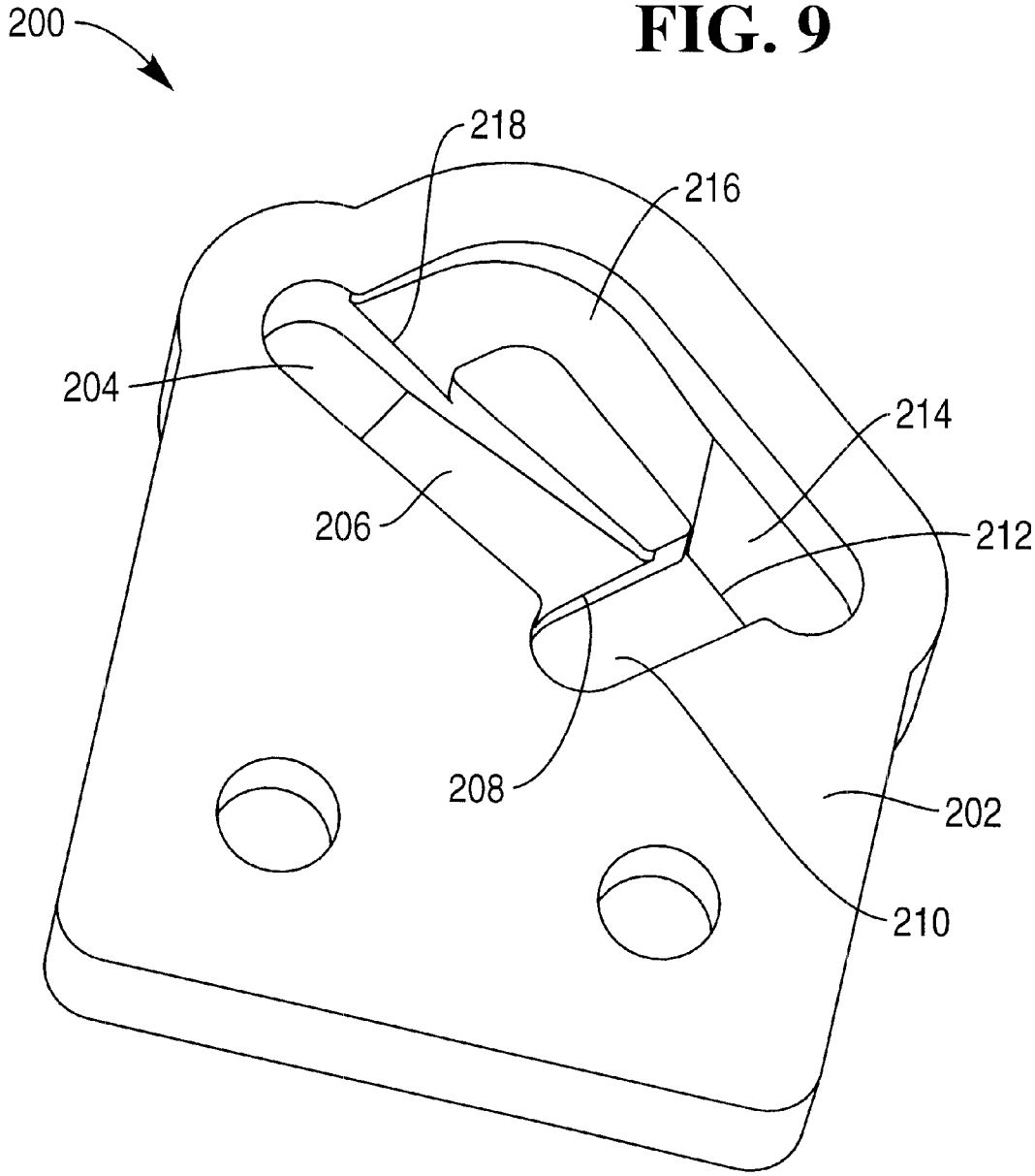
FIG. 9 is a perspective view similar to FIG. 8 and looking at the part from a slightly different direction.

A cam piece 200 (shown in detail in FIGS. 8 and 9) is securely connected to the cam holder piece 100 using a pair of suitable fasteners 108*a*, 108*b* (FIG. 7). As shown in FIGS. 8 and 9, the cam piece 200 has a face portion 202 in which a number of cam surfaces are formed. More specifically, the cam surfaces include a first flat surface 204 which runs into a first inclined surface 206. The first inclined surface 206 ramps up from the first flat surface 204 to a first edge 208 which drops onto a second flat surface 210. The second flat surface 210 runs to a second edge 212 which drops onto a third flat surface 214. The third flat surface 214 runs into a second inclined surface 216. The second inclined surface 216 ramps up from the third flat surface 214 to a third edge 218 which drops onto the first flat surface 204.

It should be apparent that the first flat surface 204 is deeper into the face portion 202 than the second flat surface 210. The first flat surface 204 and the third flat portion 214 are at approximately the same depth into the face portion 202. The first inclined surface 206 is a substantially straight inclined surface, while the second inclined surface 216 is a curved inclined surface.

Figure 10:
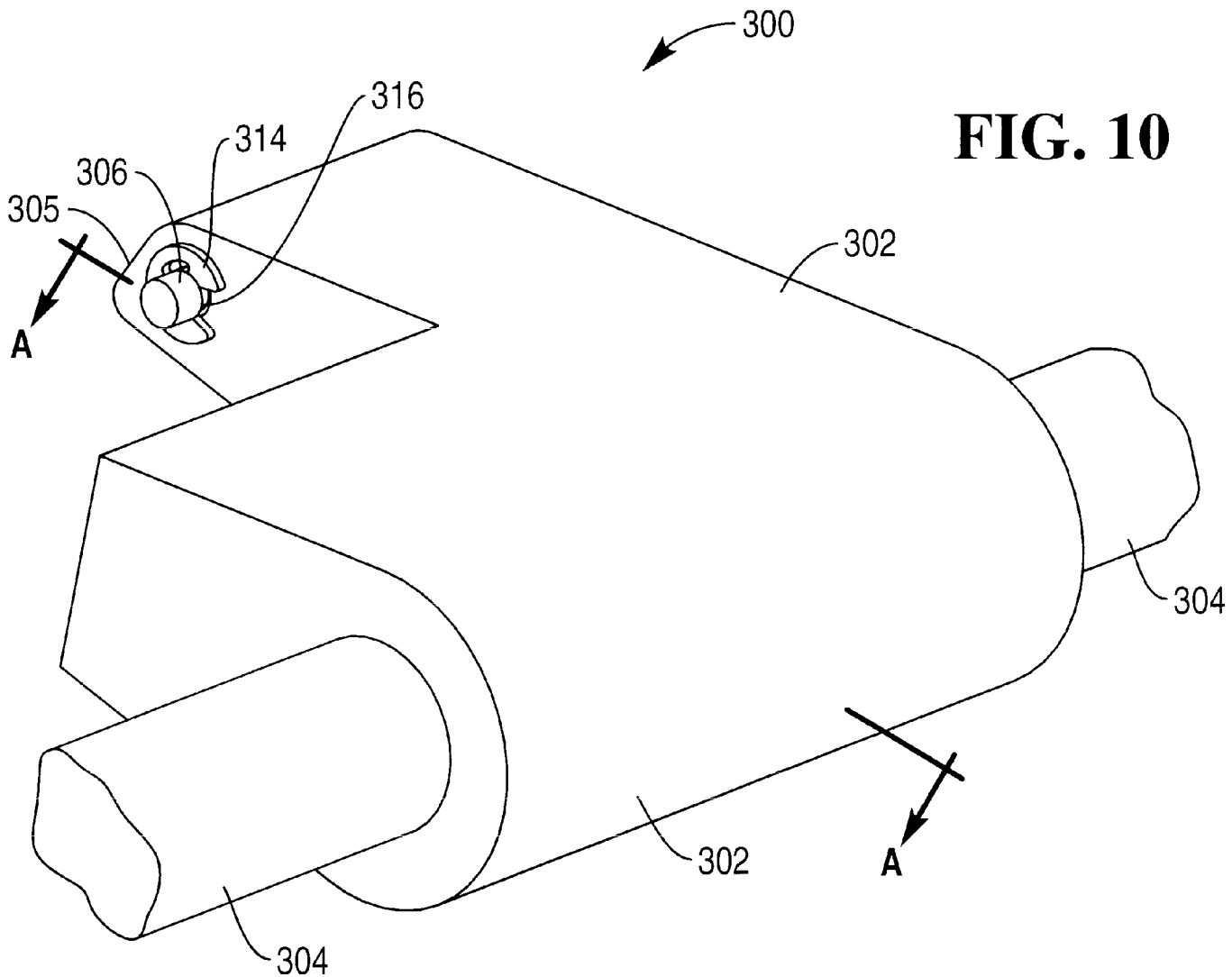
FIG. 10 is a perspective view of another part used in FIG. 6.
Figure 11:
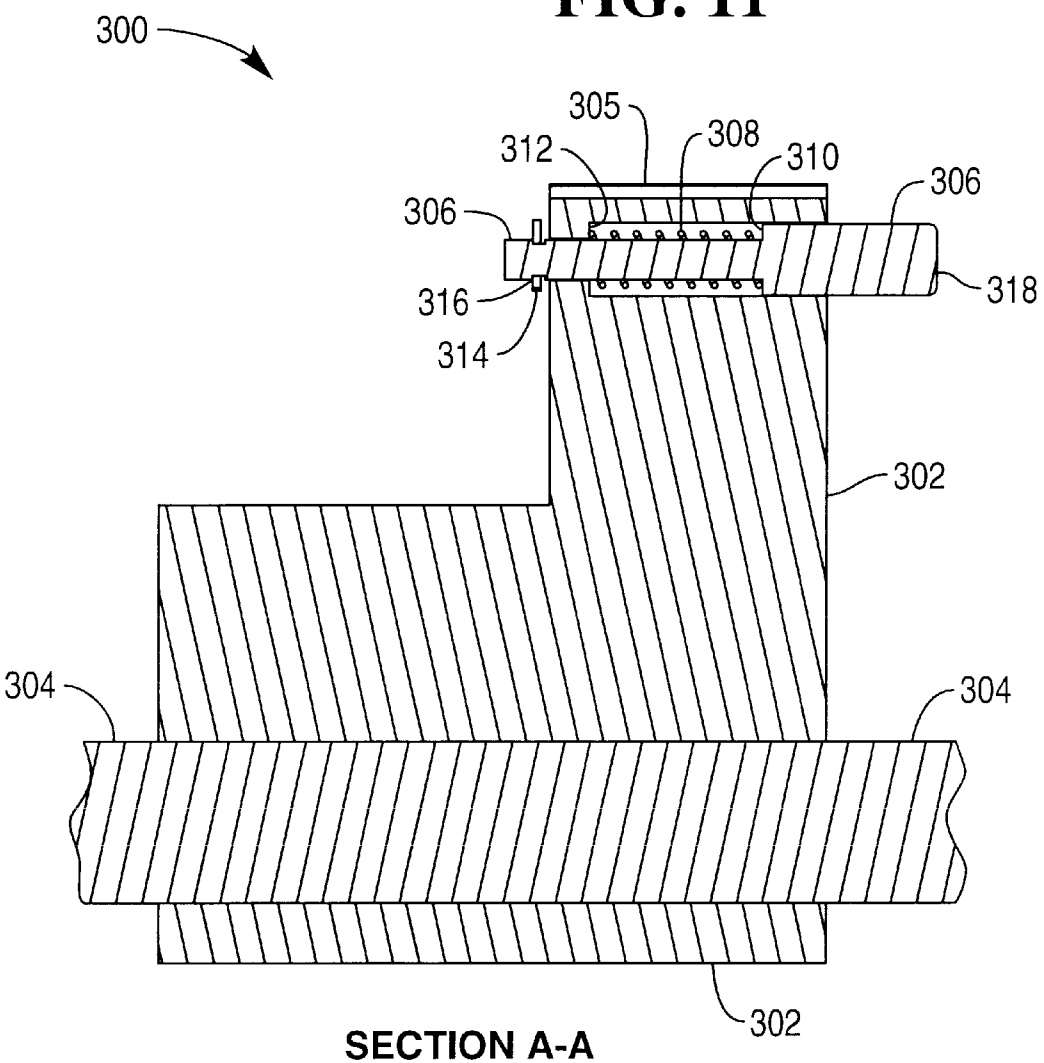
FIG. 11 is a sectional view taken approximately along line A—A in FIG. 10.

As shown in FIG. 6, the latching mechanism 90 further includes a cam follower piece 300 (shown in detail in FIGS. 10 and 11) having a body 302 and a large shaft 304 which is supported by the body 302 for rotation about its longitudinal central. The body 302 has a front edge surface 305 which is engageable with the step surface 110 (FIG. 7) of the cam holder piece 100 in a manner to be described later. The cam follower piece 300 also has a small shaft 306 and a spring 308 which is resiliently connected between an annular surface portion 310 on the small shaft 306 and an annular surface portion 312 on the body 302, as shown in FIG. 11. A C-clip 314 is connected to one end 316 of the small shaft 306 to secure the spring 308 and the small shaft 306 within the body 302. As shown in FIG. 11, the small shaft 306 is spring-loaded such that it will move back to the right (as viewed looking at FIG. 11) under the spring force of the spring 308 when the small shaft 306 is pushed to the left. The small shaft portion 306 has an end surface 318 which engages the cam surfaces of the cam piece 200 in a manner to be described in detail later.

Referring again to FIGS. 3, 4, and 5, a link arm 400 includes a pair of downward-projecting arms 402*a*, 402*b* (as best shown in FIG. 4) which are pivotably connected about a pair of pins 404*a*, 404*b*, respectively, which secured to the first and second downward-projecting extensions 62*a*, 62*b* of the main plate 52 using a number of C-clips as shown. The link arm 400 is also connected onto the ends of the large shaft 304 of the cam follower piece 300 and secured thereto using a number of C-clips as shown. The link arm 400 has a pair of holes 406*a*, 406*b* through which a cable 408 extends. One end 410 of the cable 408 is secured to the first stud portion 71 a, and the other end 412 (shown only in FIG. 3) of the cable 408 is secured to the second stud portion 71*b*. An actuator handle 414 is secured to the link arm 400 via a bracket plate 416 which is fastened to the link arm using suitable fasteners 418. The actuator handle 414 has an indented, curved portion 420 (shown only in FIG. 5) which allows a human operator to more comfortably grip and operate the actuator handle 414.

Figure 12:
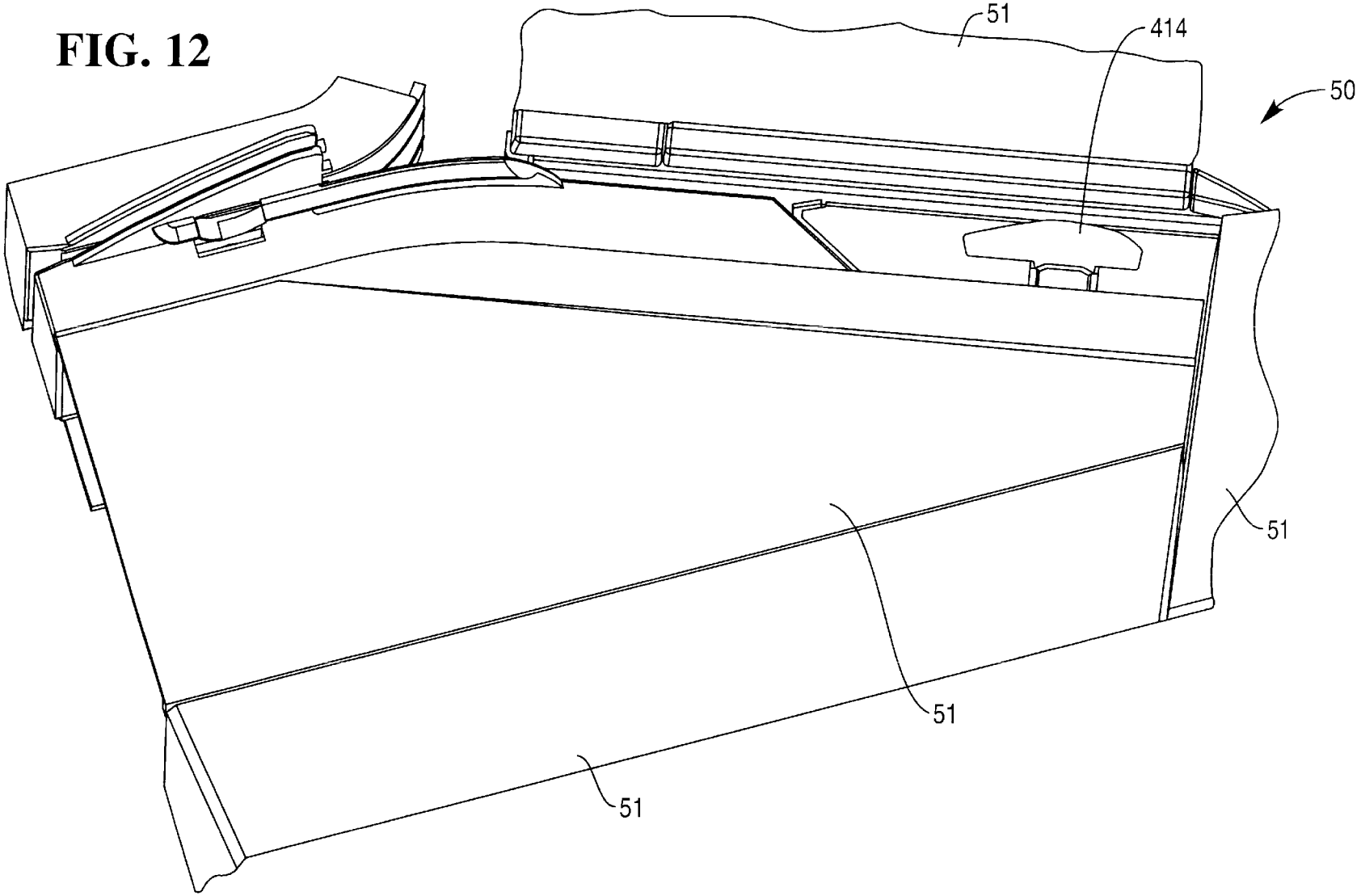
FIG. 12 is a top perspective view similar to FIG. 2 and showing the retractable track idler apparatus in a latched, retracted position.

When a human operator grips and operates the actuator handle 414 a first time and moves the actuator handle 414 from the non-retracted position shown in FIG. 2 to a retracted position shown in FIG. 12, the three idler rollers 76*a*, 76*b*, 76*c* move away from their respective drive rollers 77*a*, 77*b*, 77*c* (FIG. 3) located on the other side of the document track 14. More specifically, with reference to FIGS. 4 and 5, the link arm 400 rotates about the pins 404*a*, 404*b*, and the link arm 400 in the vicinity of the holes engages the cable 408 and thereby rotates the first and second idler mounts 70*a*, 70*b* about the shaft portion 56 of the main plate 52. When the first and second idler mounts 70*a*, 70*b* rotate about the shaft portion 56, the three idler rollers 76*a*, 76*b*, 76*c* move away from their respective drive rollers 77*a*, 77*b*, 77*c* (FIG. 3) located on the other side of the document track 14.

Figure 13:
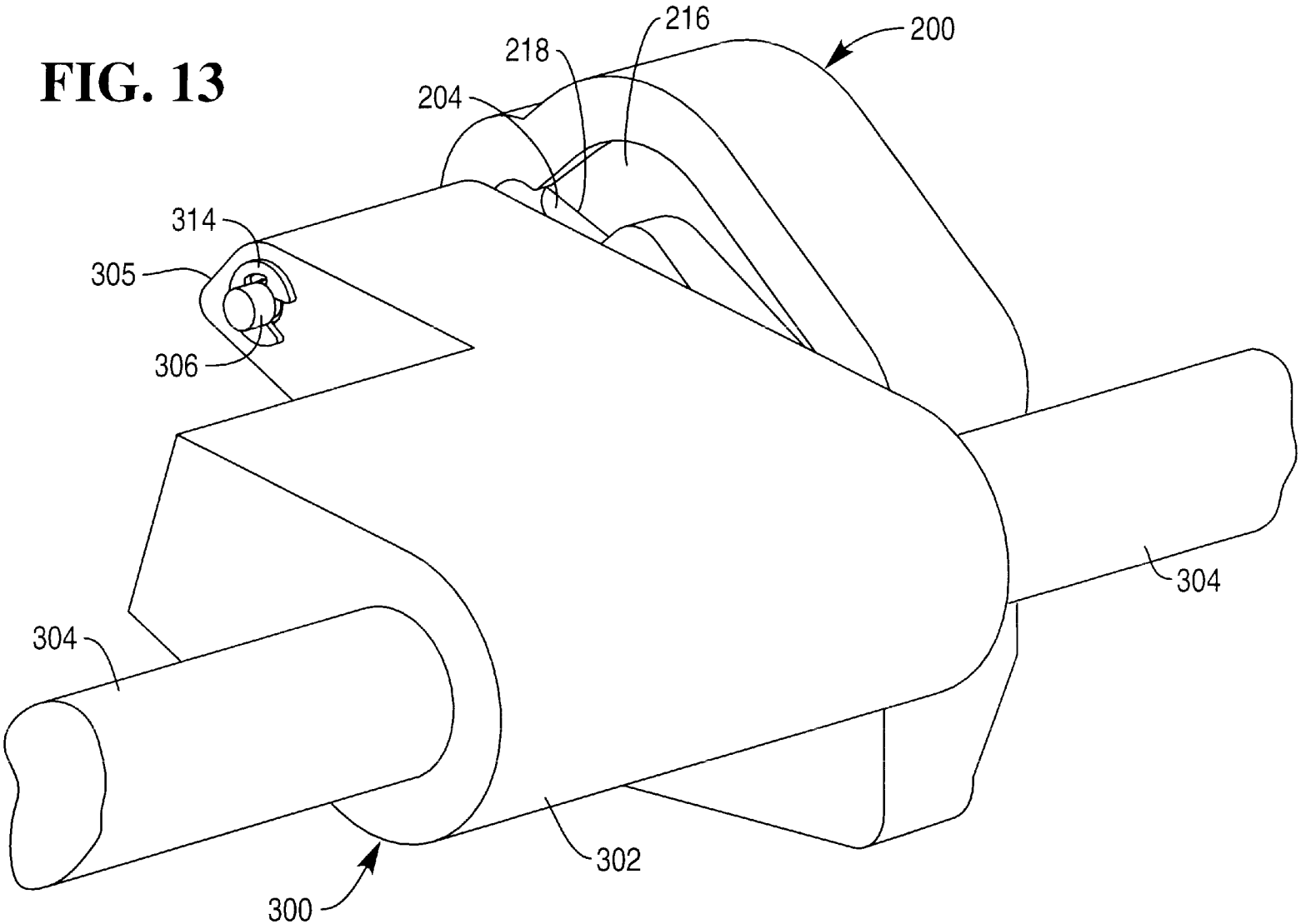
FIG. 13 is a perspective view of the part of FIG. 8 and the part of FIG. 10 operatively coupled together, and showing these parts in the non-retracted position of FIG. 2.
Figure 14:
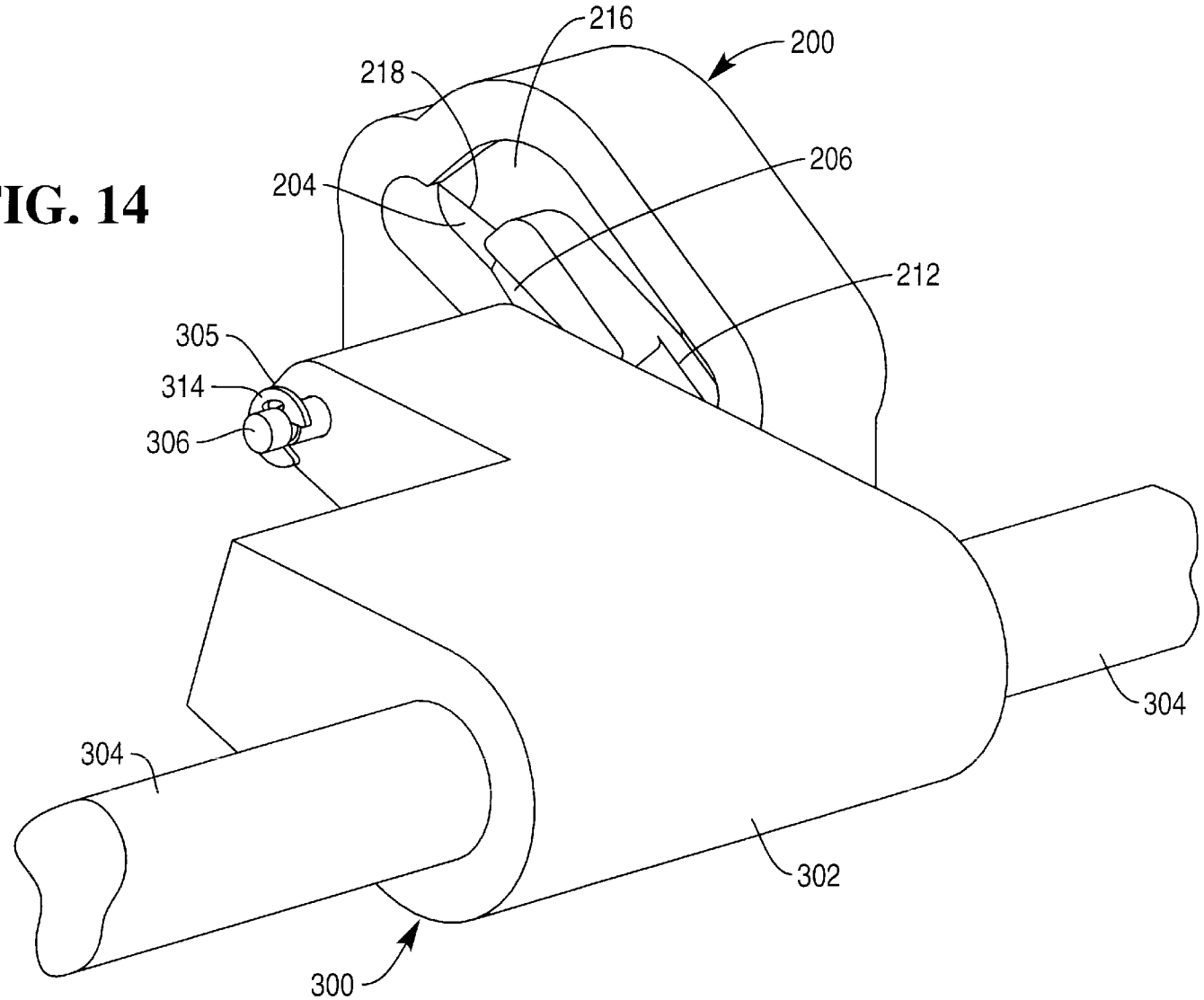
FIG. 14 is a perspective view similar to FIG. 13 and showing the parts moving to the latched, retracted position of FIG. 12.
Figure 15:
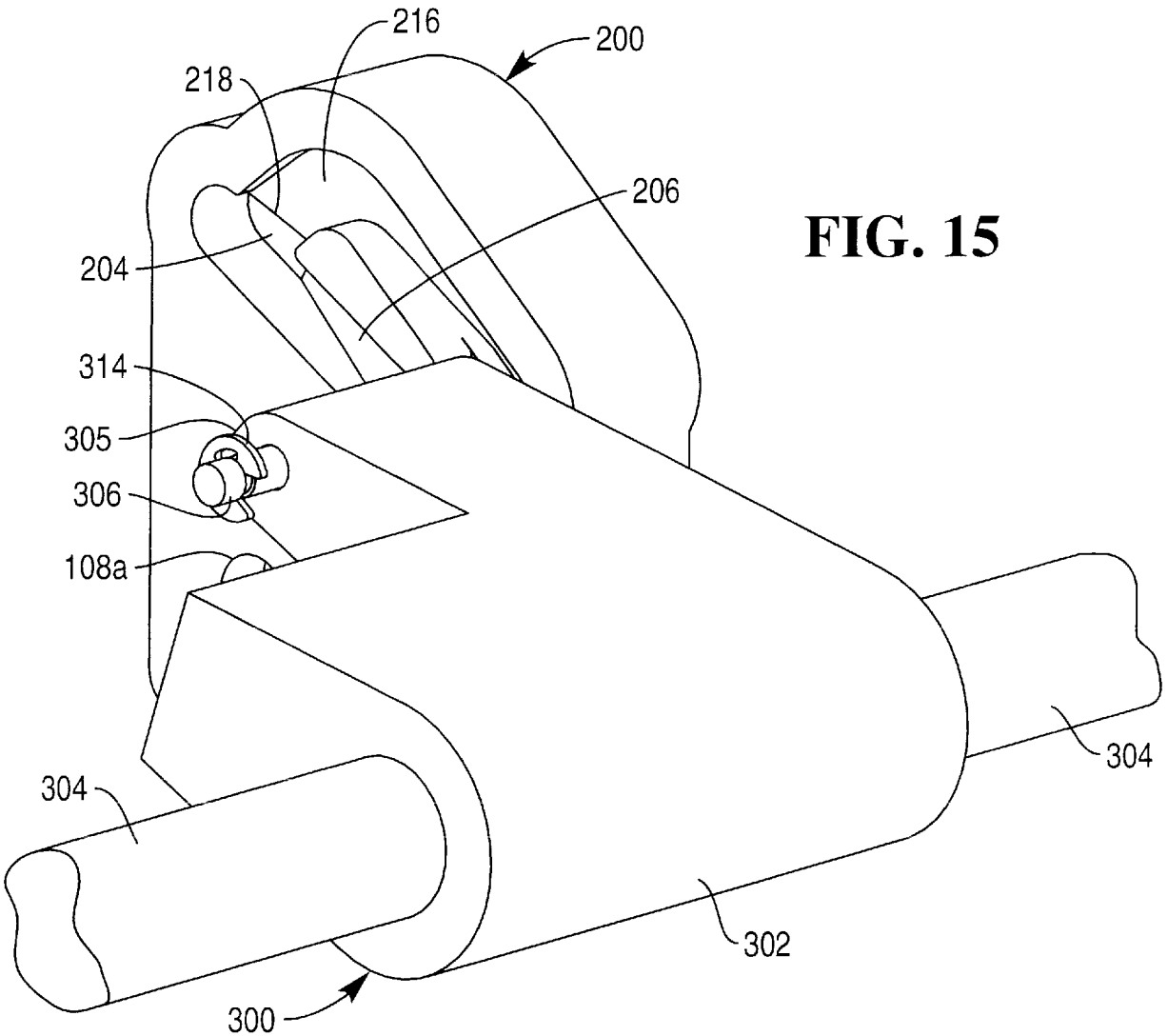
FIG. 15 is a perspective view similar to FIG. 14 and showing the parts in the latched, retracted position of FIG. 12.

At the same time the link arm 400 rotates about the pins 404*a*, 404*b*, the large shaft 304 of the cam follower piece 300 moves from a position shown in FIG. 13 (which corresponds to the non-retracted position shown in FIG. 2) through an intermediate position, such as shown in FIG. 14, until parts reach a position shown in FIG. 15 (which corresponds to the retracted position shown in FIG. 12). More specifically, as shown in the non-retracted position of FIG. 13, the end surface 318 of the small shaft 306 of the cam follower piece 300 engages the first flat surface 204 of the cam piece 200. As the large shaft 304 moves from the non-retracted position shown in FIG. 13, the end surface 318 moves up along the first inclined surface 206 of the cam piece 200, such as shown in the intermediate position of FIG. 14, until the end surface 318 drops off the first edge 208 onto the second flat surface 210 as shown in the retracted position of FIG. 15. When the end surface 318 engages the second flat surface 210, the small shaft 306 is prevented from returning back to the first flat surface 204 because the end surface 318 is unable to go back up the first edge 208 due to the spring force of the spring 308 acting on the small shaft 306 to maintain the end surface 318 in contact with the second flat surface 210.

At the same time the end surface 318 drops off the first edge 208 of the cam piece 200, the body 302 of the cam follower piece 300 drops vertically (as viewed looking at FIG. 15) until the front edge surface 305 of the cam follower piece 300 engages the step surface 110 (FIG. 7) of the cam holder piece 100. When the front edge surface 305 engages the step surface 110, the cam follower 300 is unable to return from its position shown in FIG. 15 back to the non-retracted position shown in FIG. 13. Accordingly, parts of the apparatus 50 become latched in the retracted position shown in FIGS. 12 and 15 when the actuator handle 414 and parts are moved from the non-retracted position of FIGS. 2 and 13 to the retracted position of FIGS. 12 and 15 in response to the operator operating the actuator handle 414 a first time as just described.

As parts of the apparatus 50 move from the non-retracted position shown in FIG. 13 to the latched, retracted position shown in FIG. 15, a wider gap is formed between the idler rollers 76*a*, 76*b*, 76*c* and the drive rollers 77*a*, 77*b*, 77*c*, respectively, located on the other side of the document track 14. This wider gap allows the operator to more easily access the document track 14 to clean the document track or to remove a document jammed in the document track, for examples.

Figure 16:
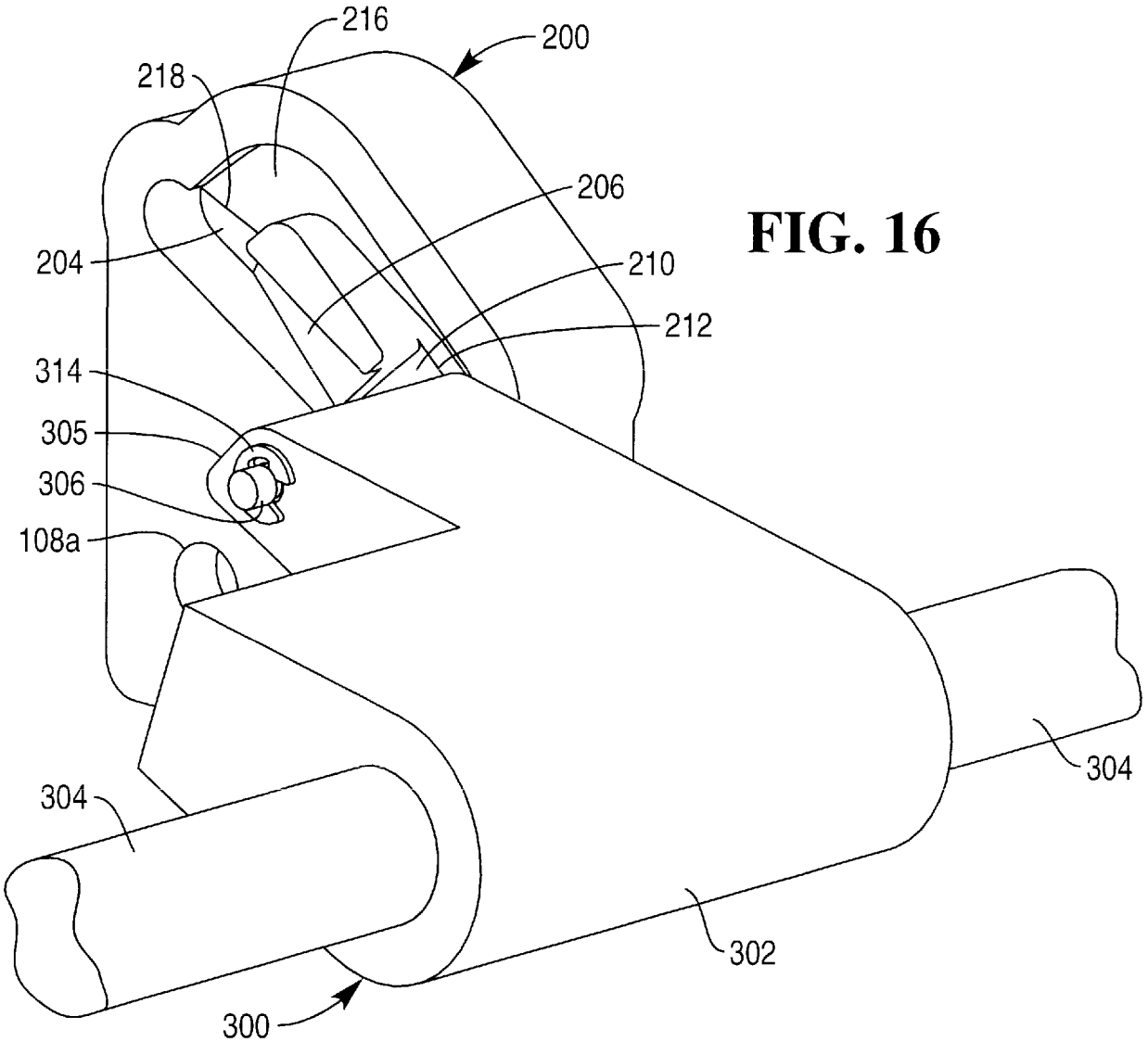
FIG. 16 is a perspective view similar to FIG. 15 and showing the parts in an unlatched, retracted position.

After the document track 14 has been cleaned or cleared of a jammed document, the operator can then grip and operate the actuator handle 414 a second time to unlatch parts of the apparatus 50 to allow the parts to return from the latched, retracted position shown in FIG. 15 to the non-retracted position shown in FIG. 13. More specifically, when the operator grips and operates the actuator handle 414 the second time to unlatch parts of the apparatus 50 shown in the latched, retracted position of FIG. 15, the end surface 318 moves off the second edge 212 of the cam piece 200 onto the third flat surface 214 as shown in FIG. 16. When parts are in the position shown in FIG. 16, the parts are unlatched but not yet returned to the non-retracted position of FIG. 13.

Figure 17:
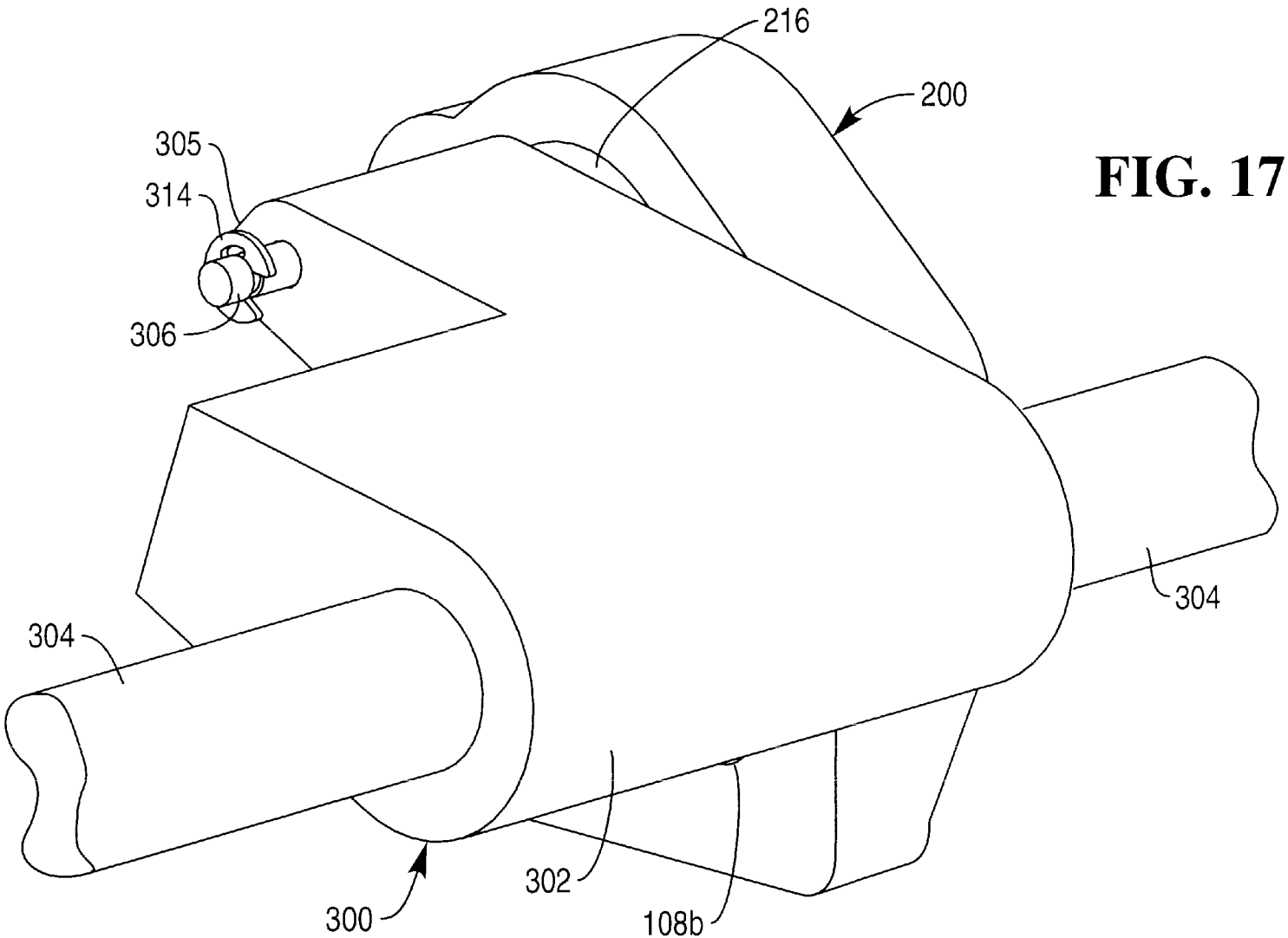
FIG. 17 is a perspective view similar to FIG. 16 and showing the parts moving back to the non-retracted position of FIG. 13.

After the parts have moved to the unlatched, retracted position shown in FIG. 16, the operator releases the actuator handle 414. When the actuator handle 414 is released, the end surface 318 moves up the second inclined surface 216 due to spring force of the first and second return springs 80*a*, 80*b* (FIG. 6). The end surface 318 continues to move up the second inclined surface 216, such as shown in the intermediate position of FIG. 17, until the end surface 318 drops back down onto the first flat surface 204 as shown in the non-retracted position of FIG. 13. Accordingly, parts of the apparatus 50 become unlatched from the latched, retracted position shown in FIGS. 12 and 15 when the actuator handle 414 and parts are moved from the latched, retracted position of FIGS. 12 and 15 back to the non-retracted position of FIGS. 2 and 13 in response to the operator operating the actuator handle 414 a second time which is after the first time as previously described.

A number of advantages result from providing the retractable track idler apparatus 50 in accordance with the present invention. One advantage is that parts of the track idler apparatus 50 can be moved from the non-retracted position shown in FIGS. 2 and 13 to the latched, retracted position shown in FIGS. 12 and 15 without having to open and/or remove any cabinetry parts, such as the outer panels 51 shown in FIG. 2, to gain access to the document track 14. This allows an operator to more easily remove a jammed document from the document track 14, and/or to more easily remove debris and clean the document track, for examples. Another advantage is that the latching mechanism holds the idler rollers in the retracted position. This allows an operator to use both hands to retrieve jammed document items from the document track 14, or to remove debris and clean the document track, for examples.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A retractable track idler apparatus comprising:

at least one idler roller for engaging a document item in a document track when the idler roller is in a non-retracted position;

a first actuatable mechanism for, when actuated a first time after a document item jam condition occurs along the document track, moving the idler roller from the non-retracted position to a retracted position away from a document item jammed in the document track to allow the jammed document item to be easily removed from the document track;

a second actuatable mechanism for, when actuated, latching the idler roller in the retracted position when the first actuatable mechanism is actuated the first time; and a third actuatable mechanism for, when actuated, unlatching the idler roller to allow the idler roller to move from the retracted position back to the non-retracted position when the first actuatable mechanism is actuated a second time which is after the first time.

2. A retractable track idler apparatus according to claim 1, wherein the first actuatable mechanism includes an actuatable member accessible to the operator from above the document track.

3. A check processing system comprising:

a number of idler rollers for engaging a document item in a document item track when the idler rollers are in a non-retracted position;

means for biasing the idler rollers to the non-retracted position;

actuatable means for (i) when actuated a first time in response to an operator operating the actuatable means against the biasing means, moving the idler rollers from the non-retracted position to a retracted position away from a document item in the document track, and (ii) when actuated a second time which is after the first time in response to an operator operating the actuatable means, allowing the idler rollers to move from the retracted position back to the non-retracted position.

4. A check processing system according to claim 3 wherein the actuatable means includes an actuatable member accessible to the operator from above the document track.

* * * * *